US008672642B2

(12) United States Patent
Tolbert, Jr. et al.

(10) Patent No.: US 8,672,642 B2
(45) Date of Patent: Mar. 18, 2014

(54) SYSTEM AND METHOD FOR STARTING A COMPRESSOR

(75) Inventors: John W. Tolbert, Jr., Bristol, TN (US); Bruce A. Moody, Kingsport, TN (US); Eugene K. Chumley, Abingdon, VA (US); Richard C. Denzau, Abingdon, VA (US); Jerry D. Edwards, Bristol, TN (US); David R. Gilliam, Bristol, VA (US); Scott Hix, Bristol, VA (US); Justin M. Toner, Kingsport, TN (US); Mark R. Trent, Bristol, VA (US); Tim M. Wampler, Bluff City, TN (US); John R. Williams, Bristol, VA (US)

(73) Assignee: Bristol Compressors International, Inc., Bristol, VA (US)

( * ) Notice: Subject to any disclaimer, the term of this patent is extended or adjusted under 35 U.S.C. 154(b) by 538 days.

(21) Appl. No.: 12/494,139

(22) Filed: Jun. 29, 2009

(65) Prior Publication Data

US 2009/0324427 A1 Dec. 31, 2009

Related U.S. Application Data

(60) Provisional application No. 61/076,676, filed on Jun. 29, 2008, provisional application No. 61/076,675, filed on Jun. 29, 2008.

(51) Int. Cl.
*F04B 43/12* (2006.01)
*F04B 49/06* (2006.01)

(52) U.S. Cl.
USPC ..... 417/53; 417/13

(58) Field of Classification Search
USPC ..... 417/13, 36, 53, 18, 44.1, 63; 62/84, 62/192, 193, 324.6, 468, 469
See application file for complete search history.

(56) References Cited

U.S. PATENT DOCUMENTS

| | | | | |
|---|---|---|---|---|
| 2,219,199 | A | | 10/1940 | Renner |
| 2,390,650 | A | * | 12/1945 | Hollatz et al. ..... 62/192 |
| 3,261,172 | A | | 7/1966 | Grant |
| 3,388,559 | A | | 6/1968 | Johnson |
| 3,411,313 | A | * | 11/1968 | Brown et al. ..... 62/192 |
| 3,874,187 | A | | 4/1975 | Anderson |
| 3,903,710 | A | | 9/1975 | Quatman |
| 4,045,973 | A | | 9/1977 | Anderson et al. |
| 4,047,242 | A | | 9/1977 | Jakob et al. |
| 4,475,358 | A | | 10/1984 | Seifert et al. |
| 4,487,028 | A | | 12/1984 | Foye |
| 4,514,989 | A | | 5/1985 | Mount |

(Continued)

FOREIGN PATENT DOCUMENTS

| | | |
|---|---|---|
| CN | 2401835 U | 10/2000 |
| DE | 4338939 C1 | 2/1995 |

(Continued)

*Primary Examiner* — Devon Kramer
*Assistant Examiner* — Amene Bayou
(74) *Attorney, Agent, or Firm* — McNees Wallace & Nurick LLC

(57) ABSTRACT

A system and method for starting a compressor is provided. An amount of liquid refrigerant that is located in an oil sump of the compressor is determined. Using the determined amount of liquid refrigerant, a starting algorithm for the compressor is selected. The selected starting algorithm is configured to remove the determined amount of liquid refrigerant from the oil sump before the compressor reaches a preselected operating speed. The selected starting algorithm is then executed to start the compressor.

20 Claims, 6 Drawing Sheets

(56) References Cited

U.S. PATENT DOCUMENTS

| | | | | |
|---|---|---|---|---|
| 4,577,471 | A | 3/1986 | Meckler | |
| 4,616,693 | A | 10/1986 | Dietzsch et al. | |
| 4,709,560 | A | 12/1987 | Voorhis et al. | |
| 4,720,981 | A | 1/1988 | Helt et al. | |
| 4,891,953 | A | 1/1990 | Isono | |
| 4,895,005 | A | 1/1990 | Norbeck et al. | |
| 4,951,475 | A | 8/1990 | Alsenz | |
| 4,965,658 | A | 10/1990 | Norbeck et al. | |
| 5,012,656 | A | 5/1991 | Tamura | |
| 5,025,638 | A | 6/1991 | Yamagishi et al. | |
| 5,044,167 | A | 9/1991 | Champagne | |
| 5,052,186 | A | 10/1991 | Dudley et al. | |
| 5,062,276 | A | 11/1991 | Dudley | |
| 5,062,277 | A * | 11/1991 | Heitmann et al. | 62/193 |
| 5,066,197 | A | 11/1991 | Champagne | |
| 5,081,846 | A | 1/1992 | Dudley et al. | |
| 5,088,297 | A | 2/1992 | Maruyama et al. | |
| 5,107,685 | A | 4/1992 | Kobayashi | |
| 5,144,812 | A | 9/1992 | Mills, Jr. et al. | |
| 5,177,972 | A | 1/1993 | Sillato et al. | |
| 5,182,915 | A | 2/1993 | Iida et al. | |
| 5,220,809 | A | 6/1993 | Voss | |
| 5,263,335 | A | 11/1993 | Isono et al. | |
| 5,285,646 | A | 2/1994 | TaeDuk | |
| 5,303,561 | A | 4/1994 | Bahel et al. | |
| 5,315,376 | A * | 5/1994 | Wada et al. | 356/432 |
| 5,323,619 | A | 6/1994 | Kim | |
| 5,350,039 | A | 9/1994 | Voss et al. | |
| 5,475,985 | A | 12/1995 | Heinrichs et al. | |
| 5,533,352 | A | 7/1996 | Bahel et al. | |
| 5,546,073 | A | 8/1996 | Duff et al. | |
| 5,553,997 | A | 9/1996 | Goshaw et al. | |
| 5,568,732 | A | 10/1996 | Isshiki et al. | |
| 5,651,260 | A | 7/1997 | Goto et al. | |
| 5,671,607 | A | 9/1997 | Clemens et al. | |
| 5,729,995 | A | 3/1998 | Tajima | |
| 5,752,385 | A | 5/1998 | Nelson | |
| 5,764,011 | A | 6/1998 | Nakae et al. | |
| 5,765,994 | A * | 6/1998 | Barbier | 417/12 |
| 5,826,643 | A | 10/1998 | Galyon et al. | |
| 6,034,872 | A | 3/2000 | Chrysler et al. | |
| 6,041,609 | A | 3/2000 | Hornsleth et al. | |
| 6,070,110 | A | 5/2000 | Shah et al. | |
| 6,116,040 | A | 9/2000 | Stark | |
| 6,172,476 | B1 | 1/2001 | Tolbert, Jr. et al. | |
| 6,237,420 | B1 * | 5/2001 | Rowlette et al. | 73/714 |
| 6,330,153 | B1 | 12/2001 | Ketonen et al. | |
| 6,353,303 | B1 | 3/2002 | Ramachandran et al. | |
| 6,363,732 | B1 | 4/2002 | Bluhm | |
| 6,375,563 | B1 | 4/2002 | Colter | |
| 6,384,563 | B1 | 5/2002 | Someya | |
| 6,434,003 | B1 | 8/2002 | Roy et al. | |
| 6,434,960 | B1 | 8/2002 | Rousseau | |
| 6,511,295 | B2 | 1/2003 | Suitou et al. | |
| 6,523,361 | B2 | 2/2003 | Higashiyama | |
| 6,524,082 | B2 | 2/2003 | Morita et al. | |
| 6,560,980 | B2 | 5/2003 | Gustafson et al. | |
| 6,560,984 | B2 | 5/2003 | Bellet | |
| 6,604,372 | B2 | 8/2003 | Baumert et al. | |
| 6,639,798 | B1 | 10/2003 | Jeter et al. | |
| 6,663,358 | B2 | 12/2003 | Loprete et al. | |
| 6,675,590 | B2 | 1/2004 | Aarestrup | |
| 6,688,124 | B1 | 2/2004 | Stark et al. | |
| 6,704,202 | B1 | 3/2004 | Hamaoka et al. | |
| 6,808,372 | B2 | 10/2004 | Makino et al. | |
| 6,817,198 | B2 | 11/2004 | Wilson et al. | |
| 6,826,923 | B2 | 12/2004 | Nakano et al. | |
| 6,829,904 | B2 | 12/2004 | Roh et al. | |
| 6,874,329 | B2 | 4/2005 | Stark et al. | |
| 6,886,354 | B2 * | 5/2005 | Dudley | 62/193 |
| 7,164,242 | B2 | 1/2007 | Federman et al. | |
| 7,290,990 | B2 * | 11/2007 | Lifson | 417/53 |
| 7,628,028 | B2 | 12/2009 | Tolbert, Jr. et al. | |
| 7,878,006 | B2 | 2/2011 | Pham | |
| 2001/0000880 | A1 | 5/2001 | Chu et al. | |
| 2001/0017039 | A1 | 8/2001 | Weimer | |
| 2002/0043074 | A1 | 4/2002 | Ott et al. | |
| 2002/0108384 | A1 | 8/2002 | Higashiyama | |
| 2003/0089121 | A1 | 5/2003 | Wilson et al. | |
| 2003/0205052 | A1 | 11/2003 | Kim et al. | |
| 2004/0003610 | A1 | 1/2004 | So et al. | |
| 2004/0055322 | A1 | 3/2004 | Monfarad | |
| 2004/0065095 | A1 | 4/2004 | Osborne et al. | |
| 2004/0139112 | A1 | 7/2004 | Wickham et al. | |
| 2004/0163403 | A1 | 8/2004 | Monfarad | |
| 2004/0174650 | A1 | 9/2004 | Wyatt et al. | |
| 2004/0194485 | A1 * | 10/2004 | Dudley | 62/193 |
| 2004/0237551 | A1 | 12/2004 | Schwarz et al. | |
| 2004/0237554 | A1 | 12/2004 | Stark et al. | |
| 2004/0261441 | A1 | 12/2004 | Turner et al. | |
| 2005/0076665 | A1 | 4/2005 | Pruitt | |
| 2005/0083630 | A1 | 4/2005 | Jun et al. | |
| 2005/0086959 | A1 | 4/2005 | Wilson et al. | |
| 2005/0100449 | A1 | 5/2005 | Hahn et al. | |
| 2005/0247073 | A1 * | 11/2005 | Hikawa et al. | 62/228.1 |
| 2006/0010891 | A1 | 1/2006 | Rayburn | |
| 2007/0022765 | A1 | 2/2007 | Lifson et al. | |
| 2007/0095081 | A1 | 5/2007 | Ootori et al. | |
| 2007/0256432 | A1 * | 11/2007 | Zugibe et al. | 62/115 |
| 2008/0041081 | A1 | 2/2008 | Tolbert | |
| 2009/0090118 | A1 | 4/2009 | Pham et al. | |
| 2009/0266091 | A1 | 10/2009 | Tolbert, Jr. | |
| 2009/0324426 | A1 | 12/2009 | Moody et al. | |
| 2009/0324428 | A1 | 12/2009 | Tolbert, Jr. et al. | |

FOREIGN PATENT DOCUMENTS

| | | | |
|---|---|---|---|
| EP | 0196863 | A1 | 10/1986 |
| EP | 0376498 | A1 | 7/1990 |
| EP | 0933603 | A1 | 8/1999 |
| EP | 1260774 | A2 | 11/2002 |
| EP | 1164035 | B1 | 8/2004 |
| JP | 58127038 | A | 7/1983 |
| JP | 6229853 | A | 2/1987 |
| JP | 1296038 | A | 11/1989 |
| JP | 4338670 | A | 11/1992 |
| JP | 6213498 | A | 8/1994 |
| JP | 814709 | A | 1/1996 |
| JP | 8145405 | A | 6/1996 |
| JP | 2000111216 | A | 4/2000 |
| JP | 2001163038 | A | 6/2001 |
| JP | 2003214659 | A | 7/2003 |
| JP | 2004219031 | A | 8/2004 |
| JP | 2004325023 | A | 11/2004 |
| JP | 2006343095 | A | 12/2006 |
| WO | 9411212 | A1 | 5/1994 |
| WO | 9815790 | A1 | 4/1998 |
| WO | 0022358 | A1 | 4/2000 |
| WO | 0078111 | A1 | 12/2000 |

* cited by examiner

SYSTEM AND METHOD FOR STARTING A COMPRESSOR

CROSS REFERENCE TO RELATED APPLICATIONS

This application claims the benefit of U.S. Provisional Application 61/076,675, filed Jun. 29, 2008 and U.S. Provisional Application 61/076,676, filed Jun. 29, 2008.

BACKGROUND

The application generally relates to a system and method for starting a compressor. The application relates more specifically to starting algorithms for a compressor that prevent hydraulic slugging and provide for proper lubrication of the compressor during the starting process.

Certain types of hermetic compressors may include an oil sump in the bottom of the compressor housing to store oil that is used to lubricate the components of the compressor. During operation of the compressor, oil is pumped from the oil sump into the components of the compressor to provide lubrication to the compressor components. In addition, the compressor housing can be filled with refrigerant vapor associated with the compression process. However, once the compressor is no longer operating or is shutdown, the refrigerant vapor in the compressor housing and other system elements can migrate and/or condense into the oil sump to form a mixture of liquid refrigerant and oil.

Starting the compressor at full speed and torque with liquid refrigerant in the oil sump, can result in damage to the compressor components. The damage can occur from inadequate lubrication due to oil dilution by the liquid refrigerant or as a result of the attempted compression of the liquid refrigerant and oil mixture (hydraulic slugging). One technique to remove or prevent liquid refrigerant from migrating and/or condensing in the oil sump is to use a heater to maintain the temperature of the oil sump and evaporate any liquid refrigerant that may be present. However, there are several drawbacks to this technique in that the continuous operation of the heater can have substantial power requirements that reduce system efficiency and the manufacturing costs associated with the heater and/or its control can thereby increase the system and operating costs.

Therefore what is needed is a system and method for starting a compressor that can minimize the effect of liquid refrigerant in the lubricating oil supply for the compressor.

SUMMARY

The present application relates to a method of starting a compressor. The method includes determining an amount of liquid refrigerant located in an oil sump of the compressor, and selecting a starting algorithm for the compressor based on the determined amount of liquid refrigerant. The selected starting algorithm is configured to remove the determined amount of liquid refrigerant from the oil sump. The method also includes starting the compressor with the selected starting algorithm.

The present application further relates to a system having a compressor, a motor drive configured to receive power from an AC power source and to provide power to the compressor and a controller to control operation of the motor drive. The controller has a processor to determine an amount of liquid refrigerant located in an oil sump of the compressor and to select a starting algorithm for the compressor in response to the determined amount of liquid refrigerant in the oil sump.

The present application also relates to a method of removing liquid refrigerant from an oil sump of a compressor. The method includes determining an amount of liquid refrigerant located in an oil sump of the compressor and selecting a starting algorithm for the compressor based on the determined amount of liquid refrigerant. The selected starting algorithm is configured to remove the determined amount of liquid refrigerant from the oil sump. The method also includes removing liquid refrigerant from the oil sump with the selected starting algorithm during a start of the compressor.

One advantage of the present application is that a separate heating element (and the corresponding controls) for the oil sump may not be required.

Another advantage of the present application is that the slow increase or ramp-up of the motor speed and/or torque during the starting of the compressor can minimize hydraulic forces in the compressor.

Still another advantage of the present application is that liquid refrigerant present in the oil sump may be removed at a rate that can reduce component stresses that would be present when trying to start the compressor at full speed and full torque.

DETAILED DESCRIPTION OF THE EXEMPLARY EMBODIMENTS

Figure 1:
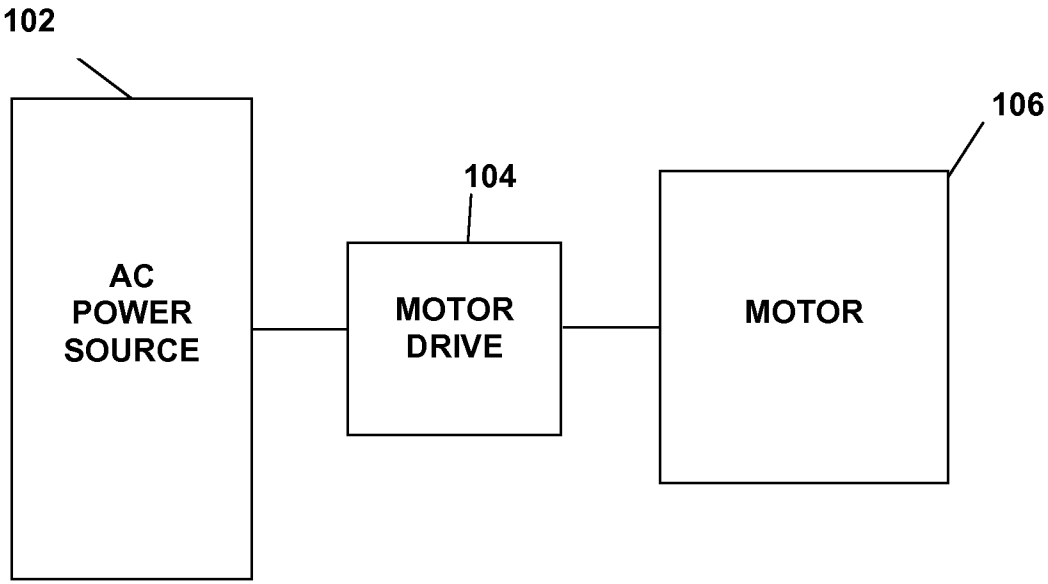
FIG. 1 schematically shows an exemplary embodiment of a system for providing power to a motor.

FIG. 1 shows an embodiment of a system for providing power to a motor. An AC power source 102 supplies electrical power to a motor drive 104, which provides power to a motor 106. The motor 106 can be used to power a motor driven component, e.g., a compressor, fan, or pump, of a vapor compression system (see generally, FIGS. 3 and 4). The AC power source 102 provides single phase or multi-phase (e.g., three phase), fixed voltage, and fixed frequency AC power to the motor drive 104. The motor drive 104 can accommodate virtually any AC power source 102. In an exemplary embodiment, the AC power source 102 can supply an AC voltage or line voltage of between about 180 V to about 600 V, such as 187 V, 208 V, 220 V, 230 V, 380 V, 415 V, 460 V, 575 V, or 600 V, at a line frequency of 50 Hz or 60 Hz to the motor drive 104.

The motor drive 104 can be a variable speed drive (VSD) or variable frequency drive (VFD) that receives AC power having a particular fixed line voltage and fixed line frequency from the AC power source 102 and provides power to the motor 106 at a preselected voltage and preselected frequency (including providing a preselected voltage greater than the fixed line voltage and/or providing a preselected frequency greater than the fixed line frequency), both of which can be varied to satisfy particular requirements. Alternatively, the motor drive 104 can be a "stepped" frequency drive that can provide a predetermined number of discrete output frequencies and voltages, i.e., two or more, to the motor 106.

Figure 2:
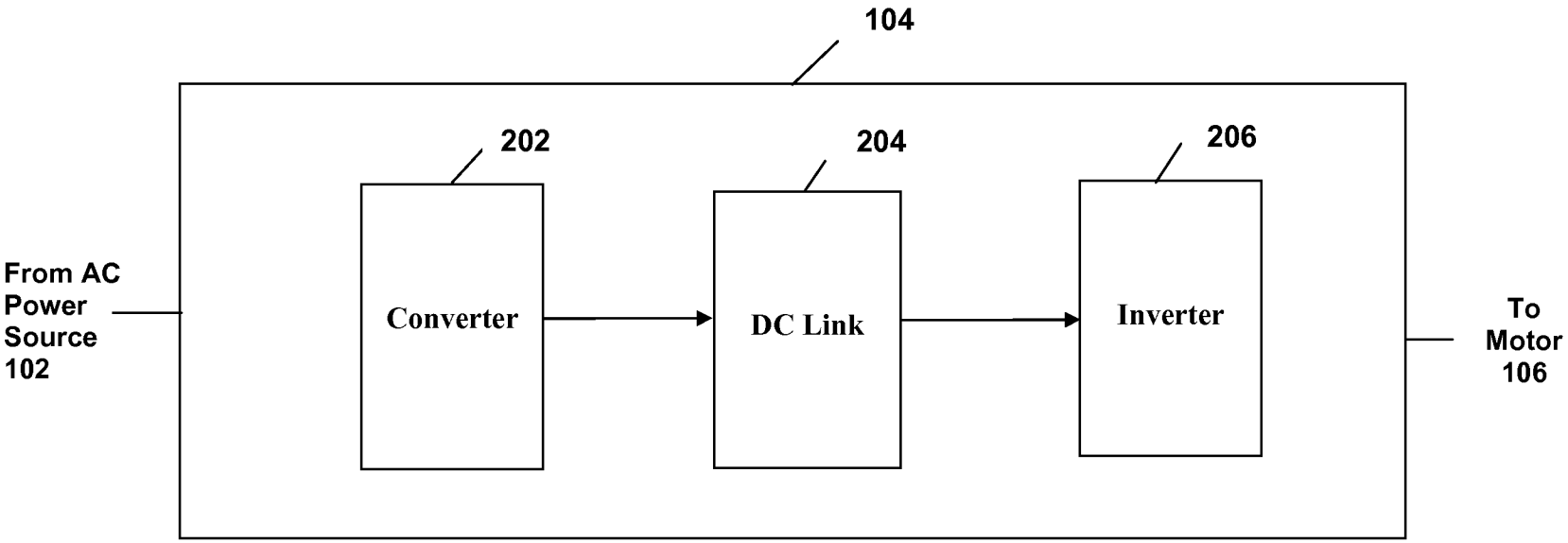
FIG. 2 schematically shows an exemplary embodiment of a motor drive.

FIG. 2 shows one embodiment of a motor drive 104. The motor drive 104 can have three components or stages: a converter or rectifier 202, a DC link or regulator 204 and an inverter 206. The converter 202 converts the fixed line frequency, fixed line voltage AC power from the AC power source 102 into DC power. The DC link 204 filters the DC power from the converter 202 and provides energy storage components. The DC link 204 can include one or more capacitors and/or inductors, which are passive devices that exhibit high reliability rates and very low failure rates. The inverter 206 converts the DC power from the DC link 204 into variable frequency, variable voltage power for the motor 106. Furthermore, in other exemplary embodiments, the converter 202, DC link 204 and inverter 206 of the motor drive 104 can incorporate several different components and/or configurations so long as the converter 202, DC link 204 and inverter 206 of the motor drive 104 can provide the motor 106 with appropriate output voltages and frequencies.

In an exemplary embodiment, the motor 106 can operate from a voltage that is less than the fixed voltage provided by the AC power source 102 and output by the motor drive 104. By operating at a voltage that is less than the fixed AC voltage, the motor 106 is able to continue operation during times when the fixed input voltage to the motor drive 104 fluctuates.

Figure 3:
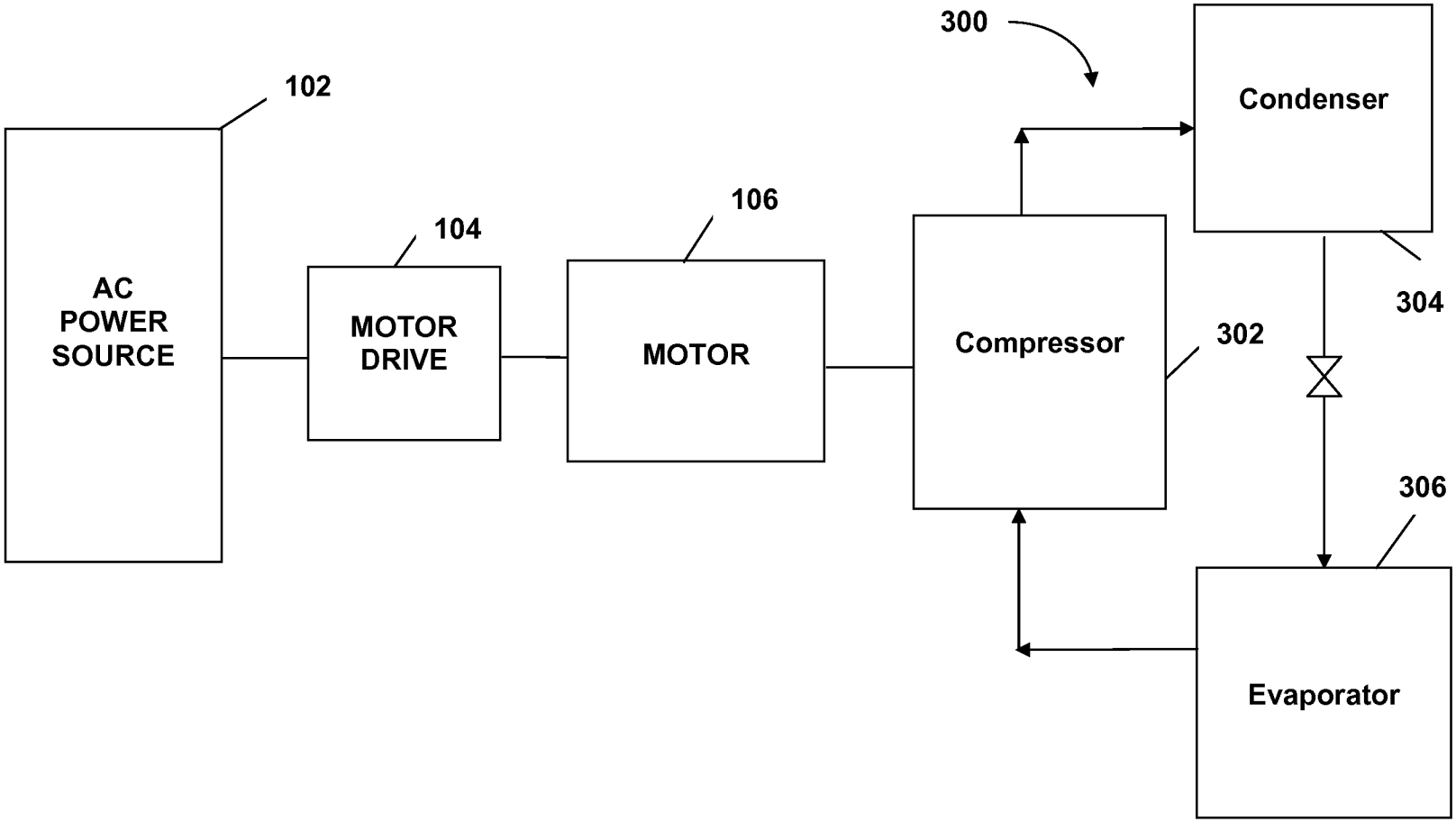
FIG. 3 schematically shows an exemplary embodiment of a vapor compression system.
Figure 4:
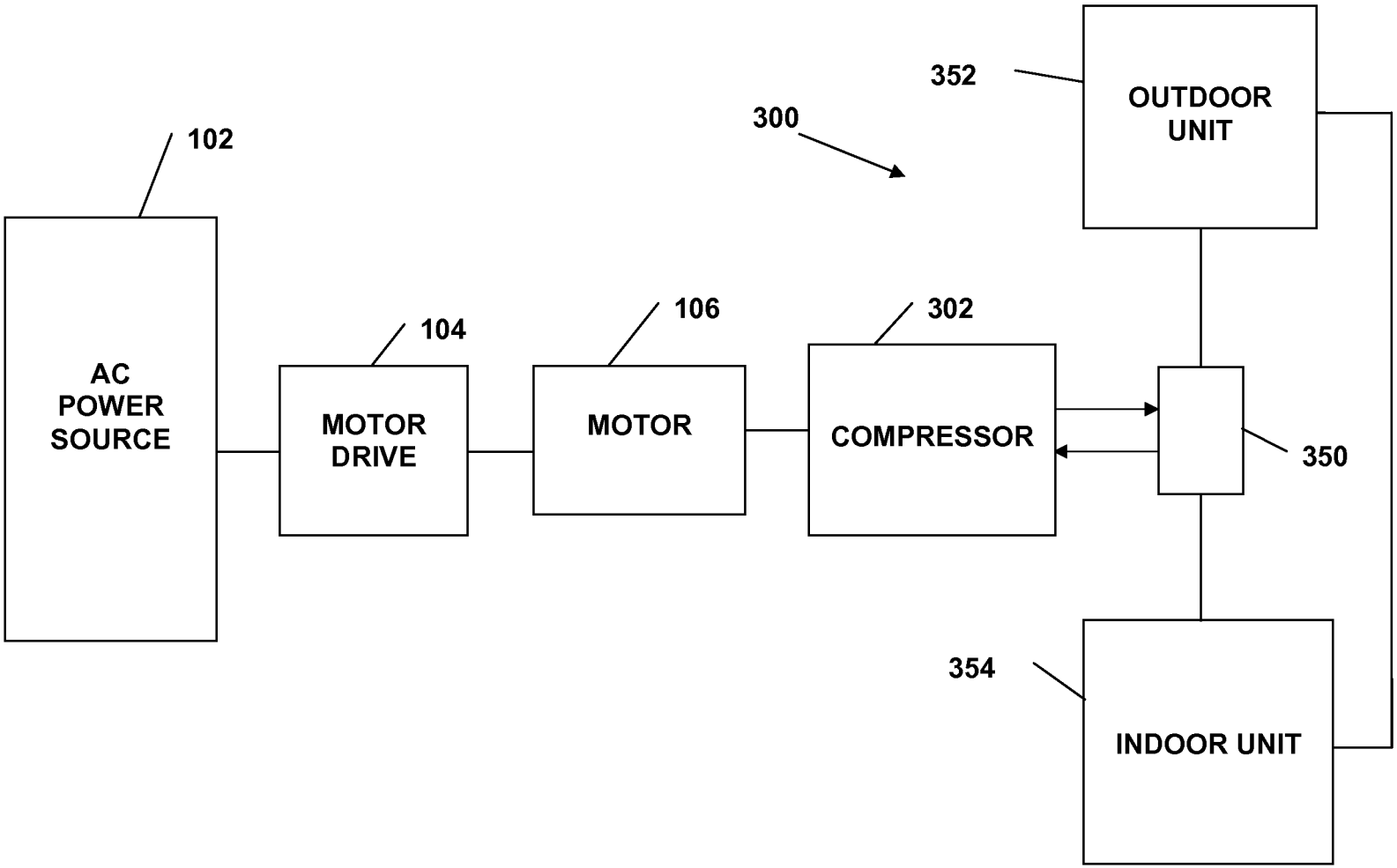
FIG. 4 schematically shows another exemplary embodiment of a vapor compression system.

As shown in FIGS. 3 and 4, a vapor compression system 300 includes a compressor 302, a condenser 304, and an evaporator 306 (see FIG. 3) or a compressor 302, a reversing valve 350, an indoor unit 354 and an outdoor unit 352 (see FIG. 4). The vapor compression system can be included in a heating, ventilation and air conditioning (HVAC) system, refrigeration system, chilled liquid system or other suitable type of system. Some examples of refrigerants that may be used in vapor compression system 300 are hydrofluorocarbon (HFC) based refrigerants, e.g., R-410A, R-407C, R-404A, R-134a or any other suitable type of refrigerant.

The vapor compression system 300 can be operated as an air conditioning system, where the evaporator 306 is located inside a structure or indoors, i.e., the evaporator is part of indoor unit 354, to provide cooling to the air in the structure and the condenser 304 is located outside a structure or outdoors, i.e., the condenser is part of outdoor unit 352, to discharge heat to the outdoor air. The vapor compression system 300 can also be operated as a heat pump system, i.e., a system that can provide both heating and cooling to the air in the structure, with the inclusion of the reversing valve 350 to control and direct the flow of refrigerant from the compressor 302. When the heat pump system is operated in an air conditioning mode, the reversing valve 350 is controlled to provide for refrigerant flow as described above for an air conditioning system. However, when the heat pump system is operated in a heating mode, the reversing valve 350 is controlled to provide for the flow of refrigerant in the opposite direction from the air conditioning mode. When operating in the heating mode, the condenser 304 is located inside a structure or indoors, i.e., the condenser is part of indoor unit 354, to provide heating to the air in the structure and the evaporator 306 is located outside a structure or outdoors, i.e., the evaporator is part of outdoor unit 352, to absorb heat from the outdoor air.

Referring back to the operation of the system 300, whether operated as a heat pump or as an air conditioner, the compressor 302 is driven by the motor 106 that is powered by motor drive 104. The motor drive 104 receives AC power having a particular fixed line voltage and fixed line frequency from AC power source 102 and provides power to the motor 106. The motor 106 used in the system 300 can be any suitable type of motor that can be powered by a motor drive 104. The motor 106 can be any suitable type of motor including, but not limited to, an induction motor, a switched reluctance (SR) motor, or an electronically commutated permanent magnet motor (ECM).

Referring back to FIGS. 3 and 4, the compressor 302 compresses a refrigerant vapor and delivers the vapor to the condenser 304 through a discharge line (and the reversing valve 350 if configured as a heat pump). The compressor 302 can be any suitable type of compressor including, but not limited to, a reciprocating compressor, rotary compressor, screw compressor, centrifugal compressor, scroll compressor, linear compressor, or turbine compressor. The refrigerant vapor delivered by the compressor 302 to the condenser 304 enters into a heat exchange relationship with a fluid, e.g., air or water, and undergoes a phase change to a refrigerant liquid as a result of the heat exchange relationship with the fluid. The condensed liquid refrigerant from the condenser 304 flows through an expansion device to the evaporator 306.

The condensed liquid refrigerant delivered to the evaporator 306 enters into a heat exchange relationship with a fluid, e.g., air or water, and undergoes a phase change to a refrigerant vapor as a result of the heat exchange relationship with the fluid. The vapor refrigerant in the evaporator 306 exits the evaporator 306 and returns to the compressor 302 by a suction line to complete the cycle (and the reversing valve arrangement 350 if configured as a heat pump). In other exemplary embodiments, any suitable configuration of the condenser 304 and the evaporator 306 can be used in the system 300, provided that the appropriate phase change of the refrigerant in the condenser 304 and evaporator 306 is obtained. For example, if air is used as the fluid to exchange heat with the refrigerant in the condenser or the evaporator, then one or more fans can be used to provide the necessary airflow through the condenser or evaporator. The motors for the one or more fans may be powered directly from the AC power source 102 or a motor drive, including motor drive 104.

Figure 5:
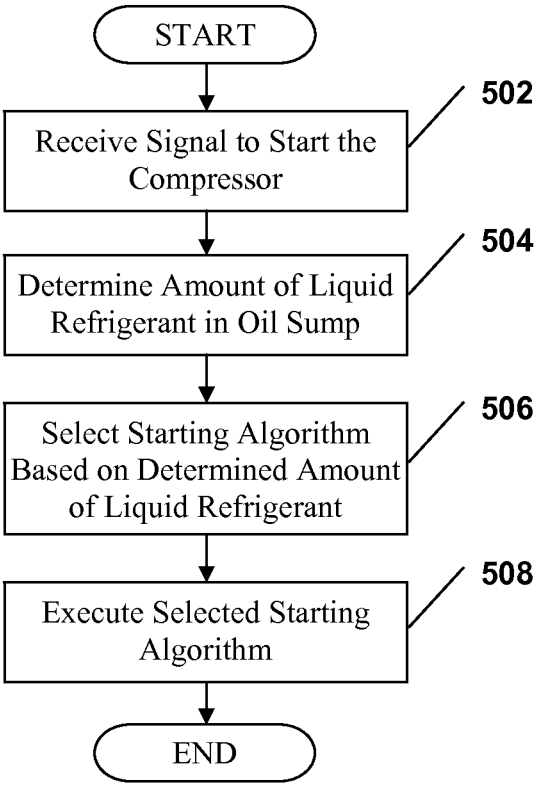
FIG. 5 shows an exemplary embodiment of a process for starting a compressor.

FIG. 5 shows an embodiment of a process for starting a compressor having a motor drive. The process begins with a controller (see e.g., FIG. 6) receiving a signal to start the compressor (step 502). The controller can be any suitable device used to control operation of the motor drive and compressor. The controller can be incorporated into the motor drive used with the compressor, incorporated in a thermostat for an HVAC system that includes the compressor or positioned as a separate component from the motor drive and/or the thermostat. The signal to start the compressor can be received from a thermostat, capacity control algorithm or other suitable device or process.

After the signal to start the compressor is received, the controller determines the amount of liquid refrigerant that is present in the oil sump of the compressor (step 504). The controller can determine the amount of liquid refrigerant in the oil sump based on the amount of time that has elapsed since the compressor was last operated. For example, if the compressor was just recently operated, e.g., less than 1 hour since last operation, then the oil sump would not have had enough time to absorb significant amounts of liquid refrigerant to be a concern. In contrast, if the compressor has not been operated for a long time period, e.g., 6 hours since last operation, then the oil sump may have significant amounts of liquid refrigerant because the system refrigerant would have had more time to migrate and/or condense into the oil. In another exemplary embodiment, a sensor, e.g., an optical, thermal or level sensor, or other device can be used to measure the amount of liquid refrigerant that is present in the oil sump.

Figure 7:
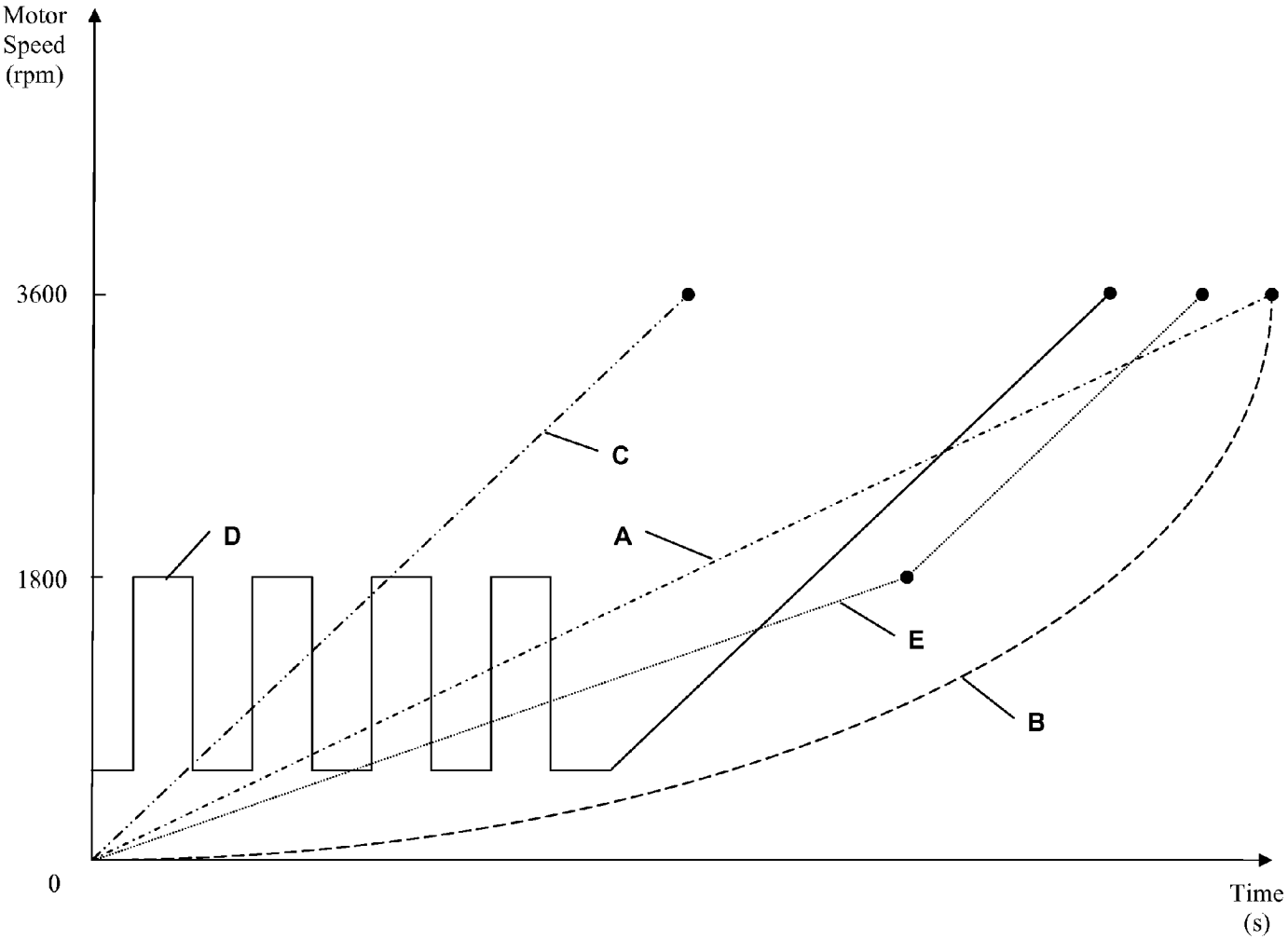
FIG. 7 shows motor speed vs. time plots for several exemplary starting algorithms.

The controller can then select an appropriate starting algorithm for the compressor based on the amount of liquid refrigerant that is determined to be in the oil sump (step 506). In other exemplary embodiments, other factors such as the preselected operating speed, compressor horsepower, compressor type, refrigerant and/or oil type or amount of system refrigerant charge may contribute to the selection of the starting algorithm. FIG. 7 shows the motor speed vs. time plot for several different starting algorithms that may be selected by the controller to reach a preselected operating speed of 3600 revolutions per minute (rpm). In another exemplary embodiment, one or more of the starting algorithms may include operation at a higher speed, e.g., 2400 rpm, for a short duration, i.e., less than 1 second, to satisfy initial torque requirements of the motor. The starting algorithms would then resume operation as shown in FIG. 7.

In one exemplary embodiment, the starting algorithm for the compressor can increase the speed and/or torque of the compressor motor as a linear or non-linear function, ramp or curve over a predetermined time period to reach a preselected operating speed for the motor. Further, there can be multiple linear and non-linear functions, ramps or curves that can be used to increase the speed and/or torque of the motor depending on the amount of liquid refrigerant that is present in the oil sump or the elapsed time since the compressor was last operated. For example, if a large amount of liquid refrigerant was determined to be in the oil sump, then the starting algorithm could slowly increase the speed and/or torque of the motor over a longer period of time to ensure that all liquid refrigerant has been removed from the oil sump. Plot A in FIG. 7 shows a linear function or ramp for slowly increasing the speed or the motor and plot B in FIG. 7 shows a non-linear function or curve for slowly increasing the speed of the motor. In contrast, if a small amount of liquid refrigerant was determined to be in the oil sump, then the starting algorithm could more rapidly increase the speed and/or torque of the motor over a shorter period of time and still provide for all the liquid refrigerant to be removed from the oil sump. Plot C in FIG. 7 shows a linear function or ramp for more rapidly increasing the speed of the motor.

In a further exemplary embodiment, the starting algorithm can slowly increase the speed and/or torque of the motor to remove liquid refrigerant from the oil sump until a predetermined motor speed was reached or a predetermined elapsed time had occurred and then, the starting algorithm can more rapidly increase the speed and/or torque of the motor until the preselected motor speed has been obtained. Plot E in FIG. 7 shows the functions or ramps for slowly increasing the speed of the motor for a period and then more rapidly increasing the speed of the motor until the preselected motor speed is obtained. In still another exemplary embodiment using a sensor to determine the amount of liquid refrigerant in the oil sump, the use of the starting algorithm can be terminated in response to the sensor determining that there is no liquid refrigerant in the oil sump and a capacity control algorithm can increase the speed and/or torque of the motor to the preselected motor speed.

Alternatively, in other exemplary embodiments, the controller can jog the compressor to remove liquid refrigerant from the oil sump before operating the compressor at a preselected operating speed. In one exemplary embodiment, the compressor can be turned on and off several times to jog the compressor. When the compressor is jogged in this exemplary embodiment, the compressor can be operated at a reduced speed level, e.g., about 1000 to about 3000 rpm, (or possibly a full speed level in another embodiment) for about 1 second to about 10 seconds before being shutdown. Once the liquid refrigerant has been removed from the oil sump as a result of jogging the compressor, the compressor speed can be increased to the preselected operating speed.

In another exemplary embodiment, the compressor can be operated at a low speed level with several speed bursts, i.e., increases in speed, to jog the compressor. When the compressor is jogged in this exemplary embodiment, the compressor can be operated at a low speed level of about 100 rpm to about 500 rpm and can then be increased in speed to about 1000 to about 3000 rpm, (or possibly a full speed level in another embodiment) for about 1 second to about 10 seconds before being returned to the low speed level. Plot D in FIG. 7 shows the jogging of the motor speed before reaching the preselected operating speed. In still a further exemplary embodiment, the low speed level for the compressor can be gradually increased as time progresses using a linear or non-linear function or ramp as discussed above. Once the liquid refrigerant has been removed from the oil sump as a result of jogging the compressor, the compressor speed can be increased to the preselected operating speed. In an exemplary embodiment, the time duration of each jog, e.g., "on" or "off" or "high speed" or "low speed", can be varied, e.g., short duration "on" jogs and longer duration "off" jogs, to satisfy particular starting requirements.

Once the starting algorithm has been selected, the controller can control the compressor and/or motor drive to execute the selected starting algorithm (step 508). After the selected starting algorithm has been executed and the compressor has reached the preselected operating speed. The compressor speed can be controlled by a capacity control algorithm or any other suitable control technique.

Figure 6:
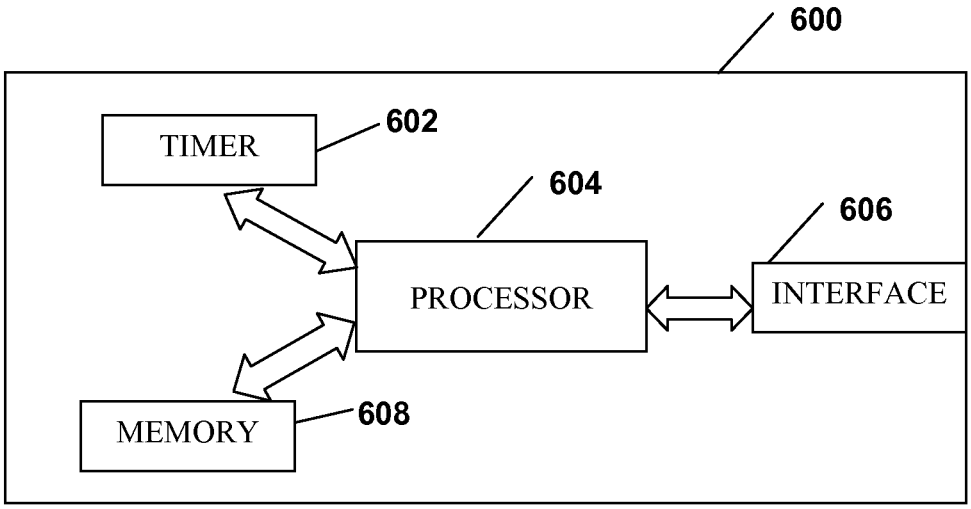
FIG. 6 schematically shows an exemplary embodiment of a controller.

FIG. 6 shows an embodiment of a controller that can be used to control the compressor and/or motor drive. The controller 600 can include a processor 604 that can communicate with an interface 606. The processor 604 can be any suitable type of microprocessor, processing unit, or integrated circuit. The interface 606 can be used to transmit and/or receive information, signals, data, control commands, etc. The processor 604 can also communicate with a timer 602 that can measure the elapsed time since the compressor was last operated or other time period. A memory device(s) 608 can communicate with the processor 604 and can be used to store the different starting algorithms, other control algorithms, system data, computer programs, software or other suitable types of electronic information.

Embodiments within the scope of the present application include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Also, two or more steps may be performed concurrently or with partial concurrence. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A method of starting a compressor comprising:

determining an amount of liquid refrigerant located in an oil sump of the compressor;

selecting a starting algorithm for the compressor from a plurality of starting algorithms based on the determined amount of liquid refrigerant;

initiating operation of a motor for the compressor;

executing the selected starting algorithm with a controller to operate the motor for the compressor, the selected starting algorithm being used to control operation of the motor to remove the determined amount of liquid refrigerant from the oil sump.

2. The method of claim 1 wherein the determining an amount of liquid refrigerant comprises determining an amount of liquid refrigerant based on an elapsed time since a previous operation of the compressor.

3. The method of claim 1 wherein the determining an amount of liquid refrigerant comprises measuring an amount of liquid refrigerant with a sensor.

4. The method of claim 3 wherein the sensor comprises one of an optical sensor, a thermal sensor or a level sensor.

5. The method of claim 1 further comprises receiving a signal to start the compressor.

6. The method of claim 1 wherein the selected starting algorithm comprises one of a linear function or a non-linear function.

7. The method of claim 1 wherein the selected starting algorithm comprises jogging the compressor.

8. The method of claim 1 wherein the selected starting algorithm comprises a plurality of linear functions.

9. A system comprising:

a compressor, the compressor comprising a motor;

a motor drive configured to receive power from an AC power source and to provide power to the motor of the compressor at a plurality of preselected voltages and a plurality of preselected frequencies;

a controller to control operation of the motor drive, the controller comprising a processor to determine an amount of liquid refrigerant located in an oil sump of the compressor and to select a starting algorithm to initiate operation of the compressor from a plurality of starting algorithms in response to the determined amount of liquid refrigerant in the oil sump; and the selected starting algorithm, when executed by the controller, operates to increase a speed of the motor from zero over a preselected time period until a preselected speed is reached to remove the determined amount of liquid refrigerant from the oil sump.

10. The system of claim 9 wherein the controller comprises a timer to measure an elapsed time since a previous operation of the compressor.

11. The system of claim 9 further comprises a sensor to measure the amount of liquid refrigerant in the oil sump.

12. The system of claim 11 wherein the sensor comprises one of an optical sensor, a thermal sensor or a level sensor.

13. The system of claim 9 wherein the selected starting algorithm comprises one of a linear function or a non-linear function.

14. The system of claim 9 wherein the selected starting algorithm comprises jogging the motor of the compressor with the motor drive prior to increasing the speed of the motor.

15. The system of claim 9 wherein the selected starting algorithm comprises a plurality of linear functions.

16. The system of claim 9 wherein the controller comprises a memory device storing the plurality of starting algorithms.

17. A method of removing liquid refrigerant from an oil sump of a compressor comprising:

determining an amount of liquid refrigerant located in an oil sump of the compressor;

selecting a starting algorithm for the compressor from a plurality of starting algorithms based on the determined amount of liquid refrigerant;

initiating operation of a motor of the compressor; and operating the motor of the compressor using the selected starting algorithm, the selected starting algorithm being used to control a speed of the motor to remove liquid refrigerant from the oil sump.

18. The method of claim 17 wherein the determining an amount of liquid refrigerant comprises determining an amount of liquid refrigerant based on an elapsed time since a previous operation of the compressor.

19. The method of claim 17 wherein the determining an amount of liquid refrigerant comprises measuring an amount of liquid refrigerant with a sensor.

20. The method of claim 17 wherein the selected starting algorithm is selected from the group consisting of a linear function, a non-linear function, jogging the compressor, a plurality of linear functions and combinations thereof.

* * * * *